US008337329B2

(12) United States Patent
Wada et al.

(10) Patent No.: US 8,337,329 B2
(45) Date of Patent: Dec. 25, 2012

(54) GOLF CLUB HEAD

(75) Inventors: Kozue Wada, Chichibu (JP); Hideo Matsunaga, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 407 days.

(21) Appl. No.: 12/364,176

(22) Filed: Feb. 2, 2009

(65) Prior Publication Data

US 2010/0105501 A1 Apr. 29, 2010

(30) Foreign Application Priority Data

Oct. 29, 2008 (JP) ..... 2008-277717

(51) Int. Cl.
*A63B 53/04* (2006.01)

(52) U.S. Cl. ..... 473/346; 473/345; 473/349

(58) Field of Classification Search ..... 473/329, 473/346, 345
See application file for complete search history.

(56) References Cited

U.S. PATENT DOCUMENTS

| | | | | |
|---|---|---|---|---|
| 6,508,722 | B1 | 1/2003 | McCabe et al. | |
| 6,623,377 | B2 | 9/2003 | Evans et al. | |
| 6,824,475 | B2 | 11/2004 | Burnett et al. | |
| 6,863,626 | B2 | 3/2005 | Evans et al. | |
| 6,904,663 | B2 | 6/2005 | Willett et al. | |
| 6,926,618 | B2 | 8/2005 | Sanchez et al. | |
| 6,997,820 | B2 | 2/2006 | Willett et al. | |
| 7,014,570 | B2 | 3/2006 | Evans et al. | |
| 7,258,626 | B2 | 8/2007 | Gibbs et al. | |
| 2006/0194644 | A1* | 8/2006 | Nishio | 473/329 |
| 2007/0142124 | A1* | 6/2007 | Ban | 473/345 |

FOREIGN PATENT DOCUMENTS

| | | | |
|---|---|---|---|
| JP | 09-192273 | A | 7/1997 |
| JP | 09-239075 | A | 9/1997 |
| JP | 09-299519 | A | 11/1997 |
| JP | 09-308713 | A | 12/1997 |

(Continued)

OTHER PUBLICATIONS

Japanese Office Action issued in Japanese Application No. 2008-277717 dated Jul. 20, 2012.

*Primary Examiner* — Michael Dennis
(74) *Attorney, Agent, or Firm* — Sughrue Mion, PLLC

(57) ABSTRACT

A golf club head maintains a low weight of a face part, keeps the resilience property of the face part in the rule conformity range, and prevents the resilience performance from decreasing even when a ball is hit by a face part deviating from the sweet spot. The golf club head has a sole, a crown, a toe, and a heel and comprises a face part formed of a metallic material. The face part comprising: an outer peripheral portion; a thick-walled portion having a wall thickness greater than that of the outer peripheral portion, the wall thickness of the thick-walled portion being greatest in a central portion of the face part and decreasing gradually from the central portion toward the outer peripheral portion, wherein the thick-walled portion is positioned over a region having a shape formed by depressing a circular or elliptical shape from two opposite sides thereof, the first depression on the toe side being directed orthogonal in the sole direction, and the second depression on the heel side being directed orthogonal in the crown direction; and at least two thin-walled portions having a wall thickness less than that of the outer peripheral portion, the thin-walled portions being positioned over a region surrounded by the two opposite sides of the circular or elliptical shape and the depressions.

6 Claims, 6 Drawing Sheets

FOREIGN PATENT DOCUMENTS

| | | | |
|---|---|---|---|
| JP | 10-137372 | A | 5/1998 |
| JP | 10-258142 | A | 9/1998 |
| JP | 2001-187174 | A | 7/2001 |
| JP | 2001-218880 | A | 8/2001 |
| JP | 2001-286586 | A | 10/2001 |
| JP | 2001-334004 | A | 12/2001 |
| JP | 2001-346916 | A | 12/2001 |
| JP | 2001-346918 | A | 12/2001 |
| JP | 2002-045445 | A | 2/2002 |
| JP | 2002-239040 | A | 8/2002 |
| JP | 2002-331051 | A | 11/2002 |
| JP | 2003-033450 | A | 2/2003 |
| JP | 2003-038690 | A | 2/2003 |
| JP | 2003-102879 | A | 4/2003 |
| JP | 2003-154040 | A | 5/2003 |
| JP | 2003-180887 | A | 7/2003 |
| JP | 2003-290398 | A | 10/2003 |
| JP | 2003-310806 | A | 11/2003 |
| JP | 2004-187795 | A | 7/2004 |
| JP | 2004-275376 | A | 10/2004 |
| JP | 2004-358224 | A | 12/2004 |
| JP | 2004-358225 | A | 12/2004 |
| JP | 2005-028170 | A | 2/2005 |
| JP | 2006-043460 | A | 2/2006 |
| JP | 2006-141806 | A | 6/2006 |
| JP | 2006-149449 | A | 6/2006 |
| JP | 2006-230772 | A | 9/2006 |
| JP | 2007-089831 | A | 4/2007 |
| JP | 2008-132276 | A | 6/2008 |
| JP | 2008-253564 | A | 10/2008 |

* cited by examiner

GOLF CLUB HEAD

BACKGROUND OF THE INVENTION

The present invention relates to a golf head club, and more particularly, relates to a golf head club in which improvement in wall thickness is made on the back surface of a face part.

Most recent wood club heads are configured so that at least a face part is formed of a metallic material. The wall thickness of the face part must be increased so as to maintain a strength capable of withstanding a shock impacted by a ball. The increase in head size continues, and on the other hand, the rule specifies that the volume of a club head must be less than 460 $cm^3$ plus an allowable error of 10 $cm^3$. Therefore, the head volumes of most drivers are very close to the upper 460 $cm^3$ limit. When the head size is increased, the sweet area expands, the peripheral weight distribution is emphasized, and the transverse and vertical moment of inertia increases, so that an error at the time of off-center hitting can be alleviated. However, if the head size is increased, and thereby the head weight is also increased, the swing balance increases, and the head speed drops, by which the carry may be decreased. To solve this problem, measures have been taken: the whole of the head may be formed of titanium or an alloy thereof (unless specially mentioned, hereinafter, "titanium or an alloy thereof" is referred to as "titanium") having a small specific gravity and a high strength, or a composite head of carbon and titanium may be used.

Also, many types of highly resilient heads having not only large head size, but also a high restitution coefficient of the head, have been developed. From the year 2008, a highly resilient head having a restitution coefficient of 0.830 or more cannot be used in competition. So far, a thick-walled face material having an increased restitution coefficient has been used positively along with the increase in head size. However, even if a highly resilient head is used, when a ball is hit by a face part other than the sweet area, that is, at the time of off-center hitting, a spring effect cannot be anticipated, and the carry tends to decrease extremely.

Japanese Patent Application Publication No. 9-192273 describes a golf club head in which a center location including a sweet spot of a part forming a face is formed so as to have a thickness capable of holding a strength sufficient to withstand a shock given by a ball, and the thickness of a part around the circumference of the center location is made thinner than that of the center location, by which the whole face is provided with spring properties.

Japanese Patent Application Publication No. 2003-154040 also describes a golf club head provided with a thick-walled region in the center of a face member. This Publication describes a golf club head in which, taking an angle that an inclined line substantially perpendicular to the axis line of a shaft makes with a face line groove as θ, the thick-walled region has a substantially elliptical shape along an axis line inclining through the angle θ to the side opposite to the face line groove with the inclined line being an axis of symmetry.

Japanese Patent Application Publication No. 2008-132276 describes a golf club head provided with a face part including a central thick-walled part provided in a central region on the back surface of face, at least four ribs extending from the central thick-walled part to the peripheral edge of the face, and thin-walled parts formed between the adjacent ribs.

In the case in which the center of the face part is made thick, as described in Japanese Patent Application Publication No. 9-192273, when a ball is hit by a face part deviating from the sweet spot, the resilience performance of face part decreases greatly compared with the case in which a ball is hit by the sweet spot. Therefore, there arises a problem in that if the resilience performance in the sweet spot is kept low, the resilience performance in a face part other than the sweet spot decreases remarkably. Also, generally, as the face part is made thinner, the resilience performance of the face part tends to become higher and the strength of the face part tends to become weaker. Therefore, there arise problems in that it is difficult to maintain the strength of the face part while keeping the weight of the face part low, and that it is difficult to obtain resilience performance close to that of the sweet spot even when a ball is hit by a face part deviating from the sweet spot while keeping the resilience performance in the sweet spot low.

SUMMARY OF THE INVENTION

The present invention has been made to solve the above problems, and accordingly an object thereof is to provide a golf club head capable of maintaining the resilience property of a face part in the rule conformity range and capable of preventing the resilience performance from decreasing greatly even when a ball is hit by a face part deviating from a sweet spot.

To achieve the above object, the present invention provides a golf club head having a sole, a crown, a toe, and a heel and comprising a face part formed of a metallic material, the face part comprising: an outer peripheral portion; a thick-walled portion having a wall thickness greater than that of the outer peripheral portion, the wall thickness of the thick-walled portion being greatest in a central portion of the face part and decreasing gradually from the central portion toward the outer peripheral portion, wherein the thick-walled portion is positioned over a region having a shape formed by depressing a circular or elliptical shape from two opposite sides thereof, the first depression on the toe side being directed orthogonal in the sole direction, and the second depression on the heel side being directed orthogonal in the crown direction; and at least two thin-walled portions having a wall thickness less than that of the outer peripheral portion, the thin-walled portions being positioned over a region surrounded by the two opposite sides of the circular or elliptical shape and the depressions. The ratio of areas which the outer peripheral portion, the thin-walled portion, and the thick-walled portion occupy in the total area of the face part is preferably 8-10:1-3:7-9.

Also, it is preferable that the face part further include a rib extending from an outer edge on the heel side and on the crown side of the face part to an outer edge on the toe side and the sole side thereof passing through the central portion of the thick-walled portion. The rib has a wall thickness greater than that of the outer peripheral portion. The ratio of areas which the outer peripheral portion, the thin-walled portion, the thick-walled portion, and the rib occupy in the total area of the face part is preferably 16-20: 2-6: 14-18: 1-6.

The wall thickness of the central portion of the thick-walled portion may be about 3.4 to about 4.0 mm, the wall thickness of the thin-walled portion may be about 1.8 to about 2.2 mm, and the wall thickness of the outer peripheral portion may be about 2.1 to about 2.5 mm. Also, the wall thickness of the rib may be about 2.5 to about 4.0 mm.

As described above, according to the golf club head in accordance with the present invention, since the thin-walled portion having a wall thickness less than that of the outer peripheral portion of a face member is formed in a region in which the thick-walled portion positioned in the center of the face part is depressed as described above, the weight of the face part can be kept low, the resilience property can be kept in the rule conformity range even when a ball is hit by the thick-walled portion, which is the sweet spot, and the resilience performance can be prevented from decreasing even when a ball is hit by a face part deviating from the sweet spot.

DESCRIPTION OF THE PREFERRED EMBODIMENTS

Figure 1:
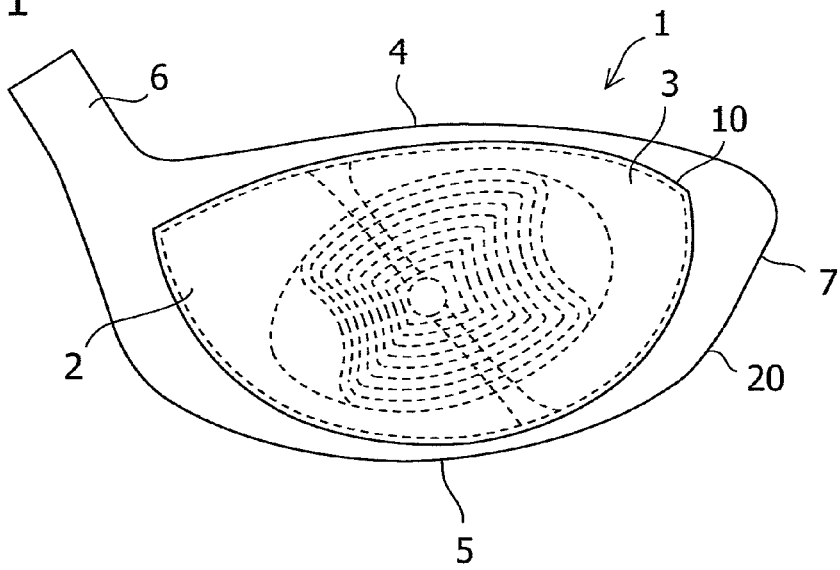
FIG. 1 is a front view showing one embodiment of a golf club head in accordance with the present invention.

One embodiment of a golf club head in accordance with the present invention will now be described with reference to the accompanying drawings. FIG. 1 is a front view showing one embodiment of a golf club head in accordance with the present invention.

As shown in FIG. 1, a golf club head 1 is made up of a face member 10 provided with a face part and a body member 20. The body member 20 includes a crown part 4, a sole part 5, a hosel part 6, and a side part 7, and is formed integrally. The face member 10 and the body member 20 are joined to each other by welding, and thereby the interior of the head is made to be a hollow structure. A construction appearing on the surface on the hollow structure side of the face member 10, that is, the back surface of the face member 10, is indicated by broken lines. On the back surface of the face member 10, irregularities for altering the thickness of the face member 10 are formed. The back surface of the face member 10 is explained.

Figure 2:
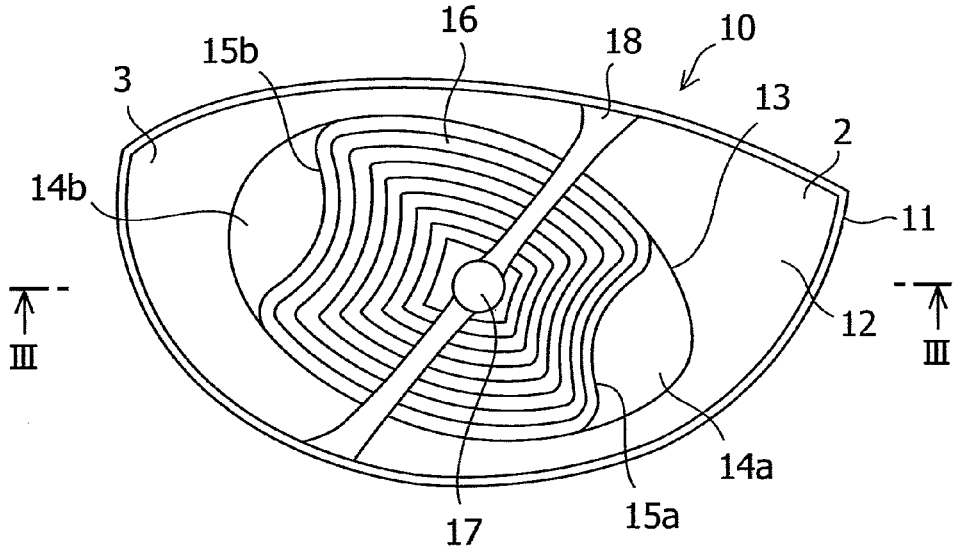
FIG. 2 is a back surface view of a face member constituting a golf club head in accordance with the present invention.
Figure 3:
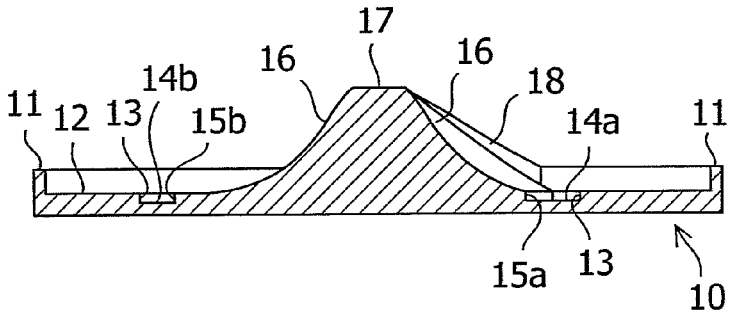
FIG. 3 is a schematic sectional view of a face member taken along the line III-III of FIG. 2.

FIG. 2 is an elevational view of a back surface of the face member 10 constituting the golf club head 1 shown in FIG. 1. FIG. 3 is a schematic sectional view of the face member 10 taken along the line III-III of FIG. 2. In FIGS. 1 and 2, contour lines are drawn to express the change in thickness of a thick-walled part 16. Also, the sectional view of FIG. 3 is presented for ease of understanding of the configuration of the present invention, and therefore is not drawn on the reduced scale.

As shown in FIG. 2, on the back surface of the face member 10, a line 13, indicating an elliptical section in which the thickness of the face member is changed with respect to an outer peripheral part 12 having a flat surface is formed. In the ellipse indicated by this line 13, a thick-walled part 16 in which the thickness increases gradually toward the center of the ellipse is formed. In both end parts of the major axis of ellipse, depressions 15*a* and 15*b* depressed in an arcuate shape toward the center direction are formed. That is, the thick-walled part 16 is surrounded by the depressions 15 and the elliptical lines 13 in both side parts of the minor axis of the ellipse.

As shown in FIGS. 2 and 3, in the center of the ellipse, there is formed a circular central part 17, the surface of which is flat and which has the greatest thickness in the face member 10. The thick-walled part 16 is configured so that the thickness decreases gradually from the central part 17 to the elliptical line 13 or the depression 15. The thickness of the outer peripheral part 12 of the ellipse is uniform. In portions surrounded by the elliptical line 13 and the depressions 15*a* and 15*b* in both end parts of the major axis of the ellipse, thin-walled parts 14*a* and 14*b* having a thickness smaller than that of the outer peripheral part 12 are formed. An outer edge part 11 of the face member 10 is formed so as to be thicker than the outer peripheral part 12. Also, on the back surface of the face member 10, the only rib 18 having a thickness far greater than the thickness of the face member is formed. The parts on the back surface of the face member 10 are explained in more detail.

The central part 17 includes a sweet spot of the golf club head 1. Also, the central part 17 includes the center point of the ellipse indicated by the line 13. The center point of the ellipse and the sweet spot may be identical or different. The radius of the central part 17 is preferably about 3.0 mm or greater, further preferably about 3.5 mm or greater. Also, the radius of the central part 17 is preferably about 6 mm or less, further preferably about 5 mm or less. By making the radius of the central part 17 in this range, the weight of the face part can be kept low. The shape of the central part 17 is not limited to the circular shape shown in FIG. 2, and may be elliptical, rectangular, or polygonal, such as tetragonal, pentagonal, or hexagonal. The thickness of the central part 17 is preferably about 3.4 mm or greater, further preferably about 3.6 mm or greater. Also, the thickness of the central part 17 is preferably about 4.0 mm or less, further preferably about 3.8 mm or less. By making the thickness of the central part 17 in this range, the restitution coefficient of the face part can be kept in the range specified by the rule.

Figure 4:
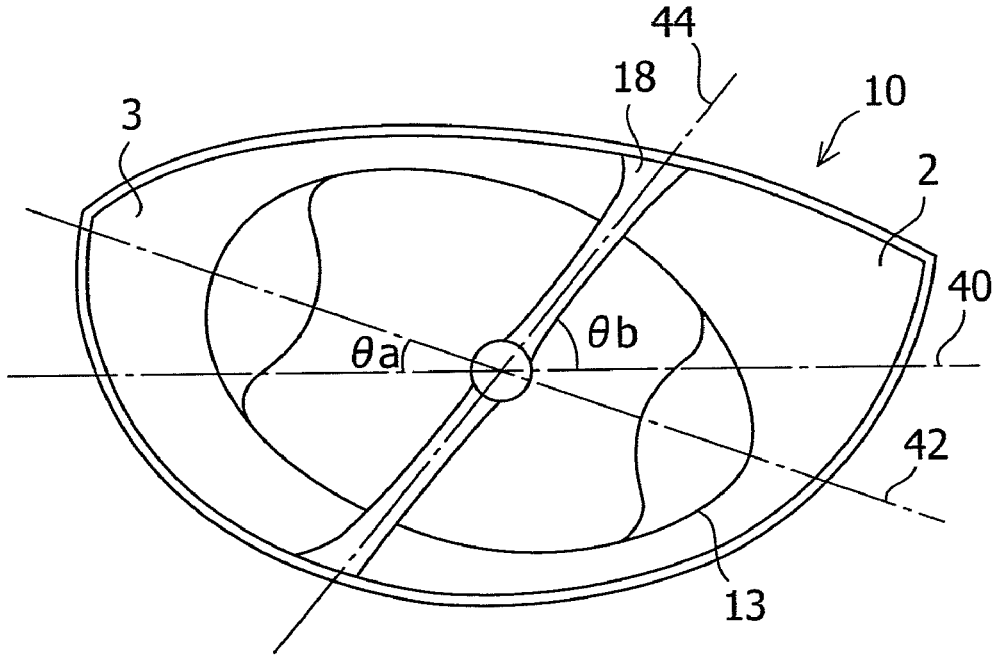
FIG. 4 is a back surface view showing angles of an ellipse and a rib in the face member shown in FIG. 2.
Figure 5:
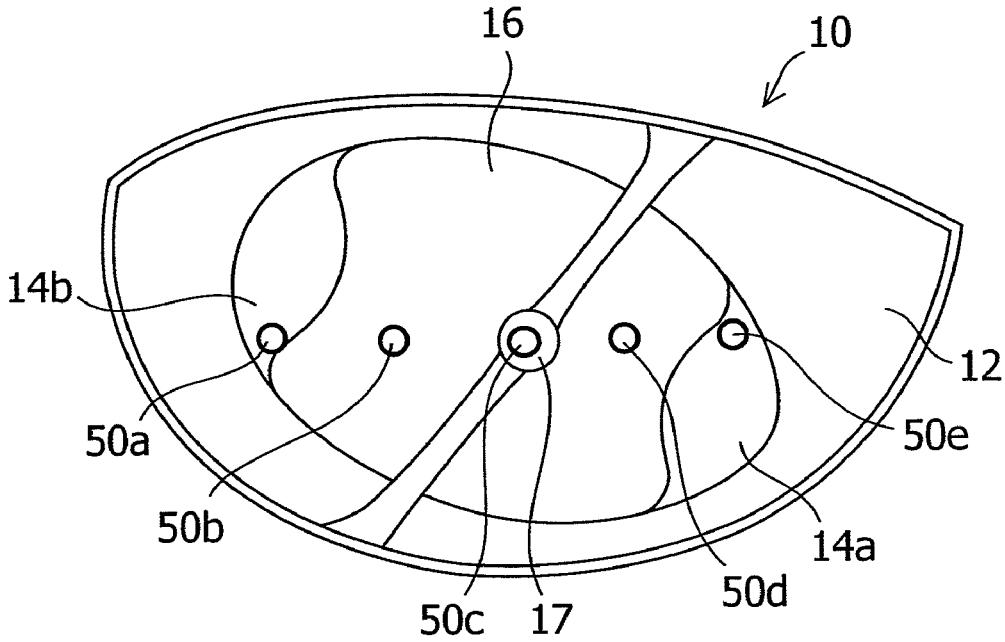
FIG. 5 is a back surface view showing the positions of hitting points in simulation of examples.

The major axis of the ellipse indicated by the line 13 is inclined so that the toe 3 side thereof shifts to the crown side and the heel 2 side thereof shifts to the sole side. The reason for this is as described below. Since the variations in hitting points of golfers are generally biased to the crown side on the toe 3 side and to the sole side on the heel 2 side, by this inclination, more hitting points at the time when a ball is hit by a face part deviating from the sweet spot can be allowed to enter the region of the thin-walled part 14. Specifically, as shown in FIG. 4, an inclination θa of a major axis 42 of the ellipse with respect to a horizontal line 40 at the time when the golf club head is placed at a normal address position is preferably about 5 degrees or greater, further preferably about 10 degrees or greater. Also, the inclination θa of the major axis 42 of the ellipse is preferably about 40 degrees or less, further preferably about 30 degrees or less.

The ratio of the length of the major axis of the ellipse indicated by the line 13 to the length of the minor axis thereof is preferably in the range of 100:50 to 50:50, further preferably in the range of 95:50 to 70:50 (needless to say, in the case in which the major axis and the minor axis have an equal length, the shape is not elliptical, but is circular). Also, the ratio of the length of the thick-walled part 16 on the major axis of ellipse (that is, the length between the depressions 15*a* and 15*b*) to the length of the thick-walled part 16 on the minor axis is preferably in the range of 5:4 to 5:6. The radius of curvature of the depression 15*a* on the sole side is preferably about 12 mm or greater, further preferably about 13 mm or greater. Also, the radius of curvature of the depression 15*a* on the sole side is preferably about 25 mm or less, further preferably about 20 mm or less.

As shown in FIG. 3, the thick-walled part 16 has a curved surface spreading toward the bottom, such as that from the central part 17 to the elliptical line 13 or the depression 15. However, the shape of the thick-walled part 16 is not limited to this shape. For example, the thick-walled part 16 may have a stepwise surface such that the thickness thereof decreases stepwise, or it may have a surface of a truncated cone shape such that the thickness thereof decreases continuously in a fixed ratio.

The outer peripheral part 12 has a uniform thickness ranging from the elliptical line 13 to the outer edge part 11. The thickness of the outer peripheral part 12 is preferably about 2.1 mm or greater, further preferably about 2.2 mm or greater. On the other hand, the thickness of the outer peripheral part 12 is preferably about 2.5 mm or less, further preferably about 2.4 mm or less. By making the thickness of the outer peripheral part 12 in this range, the weight of the face part can be reduced while the restitution coefficient is restrained.

The thin-walled part 14 is formed so that the thickness thereof is less than that of the outer peripheral part 12. A difference in thickness between the thin-walled part 14 and the outer peripheral part 12 is preferably about 0.1 mm or greater, further preferably about 0.2 mm or greater. Also, the thickness of the thin-walled part 14 is preferably about 1.8 mm or greater, further preferably about 1.9 mm or greater. On the other hand, the thickness of the thin-walled part 14 is preferably about 2.2 mm or less, further preferably about 2.1 mm or less. By making the thickness of the thin-walled part 14 in this range, the resilience performance can be improved on the toe side and the heel side on which the resilience performance is usually low.

The rib 18 has a thickness at least greater than the thickness of the outer peripheral part 12. As shown in FIG. 3, the rib 18 is configured so that the thickness thereof decreases continuously from the thickness that is the same as the thickness of the central part 17 toward the outer edge part 11. By decreasing the thickness of the rib 18 from the central part 17 toward the outer edge part 11 in this manner, the decrease in the resilience performance of the face surface can be kept to a minimum while the strength of the face surface is maintained. The change in thickness of the rib 18 is not limited to the above-described one. For example, the thickness of the rib 18 can be made fixed. The thickness of the rib 18 is preferably about 2.5 mm or greater, further preferably about 2.7 mm or greater. On the other hand, the thickness of the rib 18 is preferably about 4.0 mm or less, further preferably about 3.6 mm or less.

As shown in FIG. 2, the rib 18 is formed so as to extend substantially in a straight line form from the outer edge part 11 on the heel 2 side and the crown side to the outer edge part 11 on the toe 3 side and the sole side passing through the central part 17 of the thick-walled part 16. As shown in FIG. 4, an inclination θb of a centerline 44 of the rib 18 with respect to the horizontal line 40 at the time when the golf club head is placed at a normal address position is preferably about 45 degrees or greater, further preferably about 50 degrees or greater. Also, the inclination θb of the rib 18 is preferably less than about 90 degrees, further preferably about 80 degrees or less. By making the inclination θb of the rib 18 in this range, since the variations in ball hitting points are biased as described above, the strength of the face surface can be maintained without impairing the resilience performance at the time of off-center hitting so much. As shown in FIG. 2, the rib 18 is formed so that the width thereof is increased in a portion adjacent to the central part 17 or the outer edge part 17. However, the shape of the rib 18 is not limited to this. For example, the width of the rib 18 may be uniform.

The ratio of areas which the outer peripheral part 12, the thin-walled part 14, the thick-walled part 16 herein, including the central part 17), and the rib 18 occupy in the total area of the face part 10 is preferably 16-20:2-6:14-18:1-6, further preferably 17-19:3-5:15-17:1-5. By making this ratio in this range, the weight and strength of the whole face can be balanced. In the case in which the rib 18 is not provided, the ratio of areas which the outer peripheral part 12, the thin-walled part 14, and the thick-walled part 16 (herein, including the central part 17) occupy is preferably 8-10:1-3:7-9, and more preferably 17-19:3-5:15-17.

The face member 10 can be formed by either method of forging or casting. Also, as a material for the face member 10, titanium, titanium alloy, stainless steel, or the like can be used. The volume of the golf club head 1 is preferably about 100 cc or greater, and more preferably about 350 cc or greater. On the other hand, the volume of the golf club head 1 is preferably about 500 cc or less, and more preferably about 480 cc or less. Also, the weight of the golf club head 1 is preferably about 150 g or more, and more preferably about 160 g or more. On the other hand, the weight of the golf club head 1 is preferably about 250 g or lower, and more preferably about 200 g or lower.

FIG. 3 shows the face member 10 so that the ball hitting side thereof is flat for ease of understanding the configuration of the present invention. However, the ball hitting surface of the face member 10 can be formed with a bulge having a radius of curvature of 250 to 800 mm. Also, similarly, the ball hitting surface of the face member can be formed with a roll having a radius of curvature of 250 to 800 mm.

Also, in this embodiment, the case in which the whole of the face part of the golf club head 1 is the face member 10 as shown in FIG. 1 has been explained. However, the configuration is not limited to this. For example, the configuration may be made such that a central portion of the face part is made the face member, and the remaining portions at both ends of the face part are formed integrally with the head body.

Examples

For the face member in accordance with the present invention, the initial velocity (m/s) and the deflection (mm) at the time when a golf ball (mass: 44.7 g) is hit at a head speed of 45 m/s were calculated by simulation using a computer. The configuration of the face member was as shown in FIGS. 2 and 3. As the design conditions of face member, the length of the major axis of the ellipse was set at 64 mm, the length of the minor axis thereof at 40 mm, the angle θa of the ellipse at 15 degrees, the radius of curvatures of the depressions on the toe side and the heel side at 32 mm and 12 mm, respectively. The angle θb of the rib was set at 60 degrees. The ratio of areas which the outer peripheral part, the thin-walled part, the thick-walled part, and the rib occupy in the total area of the face part was set at 45:11:40:4. This ratio was calculated so that the central part was included in the thick-walled part, and the central part was set at 1% of the whole of the face part.

The thicknesses of the central part, the outer peripheral part, and the thin-walled part were set at 3.6 mm, 2.3 mm, and 2.0 mm, respectively. The thickness of the thick-walled part was set so as to change from 3.6 mm in the central part to 2.3 mm in the outer peripheral part. The thickness of the rib was set so as to change from 3.6 mm in the central part to 3.3 mm in the outer edge part. As the material of the face member, a titanium alloy was assumed, and the Young's modulus thereof was set at 108 GPa, and the Poisson's ratio was set at 0.30. Also, the weight of the golf club head was set at 190 g.

Regarding the ball hitting point, five different hitting points in the horizontal direction were examined. A central hitting point 50*c* was set by assuming ball hitting in the sweet spot, and was set in the central part of the face member. Four other hitting points were set by assuming ball hitting deviating from the sweet spot. Hitting points 50*b* and 50*d* were set at positions in the thick-walled part 16 separated 12.5 mm from the central hitting point 50*c* to the toe side and the heel side, respectively, and hitting points 50*a* and 50*e* were set at positions in the thin-walled part 14 separated 12.5 mm further to the toe side and the heel side.

Figure 6:
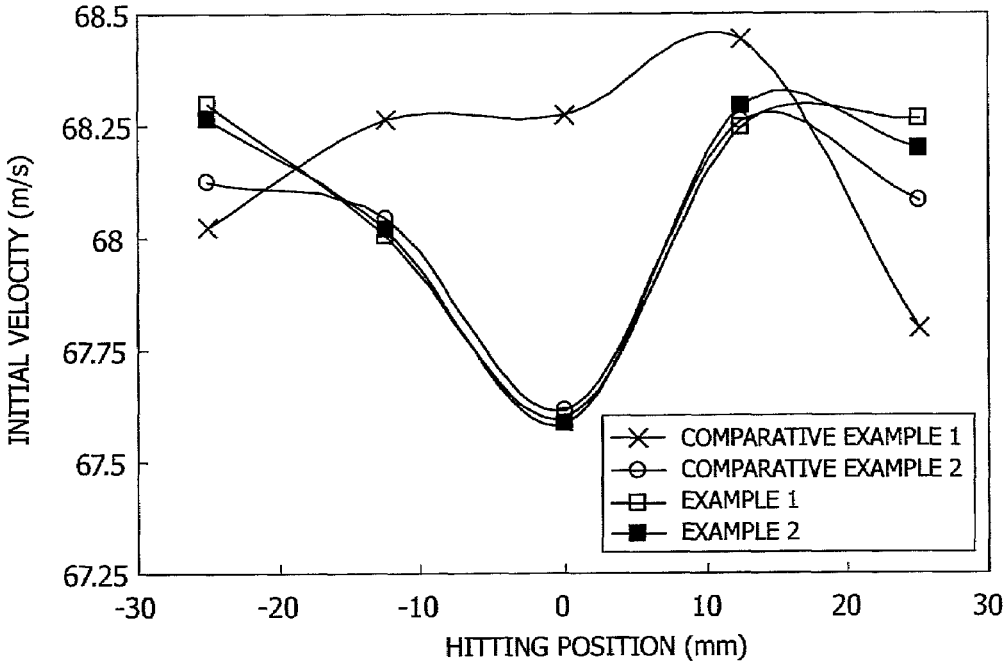
FIG. 6 is a graph showing simulation results of initial velocity of examples 1 and 2.
Figure 7:
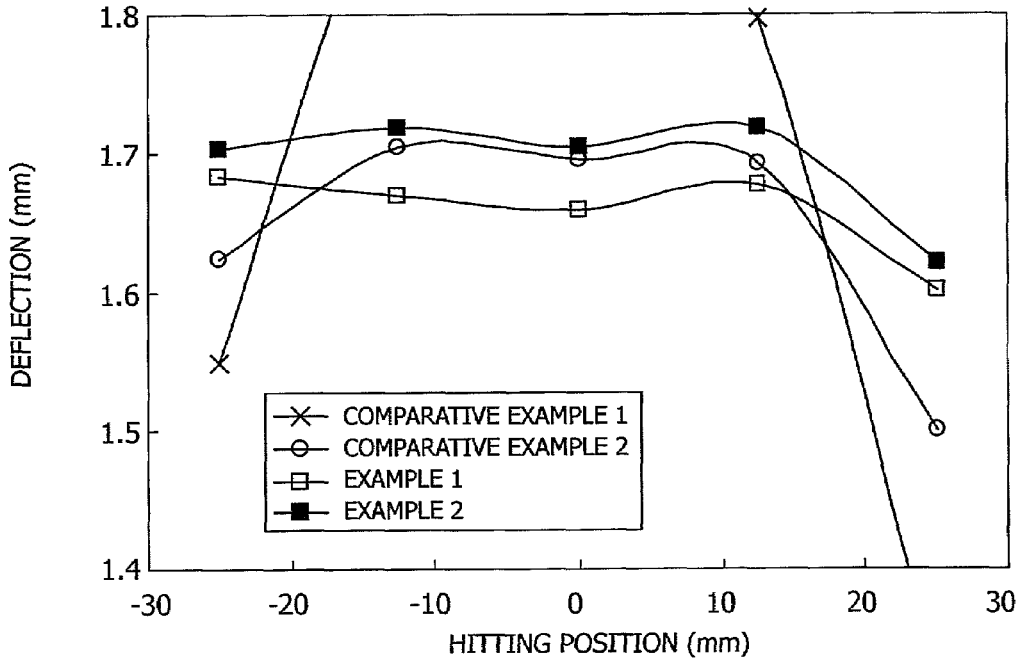
FIG. 7 is a graph showing simulation results of deflection of examples 1 and 2.

FIGS. 6 and 7 show the simulation results (example 1) of initial velocity and deflection simulated under the above conditions, respectively. In the graphs of FIGS. 6 and 7, the position of the central hitting point 50*c* is taken as 0 mm, and the distance toward the heel side is expressed by a plus sign, and the distance toward the toe side is expressed by a minus sign.

Also, the initial velocity and the deflection were simulated under the same conditions as those in example 1, except that the rib was not provided (example 2). For comparison, simulation was performed under the same conditions as those in example 1 except that the thickness of the whole of the face part was set uniformly at 2.5 mm (comparative example 1). Also, simulation was performed under the same conditions as those in example 1 except that the thickness of the thin-walled part was the same as that of the outer peripheral part and the rib was not provided (comparative example 2). These simulation results are also shown in FIGS. 6 and 7. The design conditions of examples 1 and 2 and comparative examples 1 and 2 are collectively given in Table 1.

TABLE 1

| | Area ratio (%) | | | | Thickness (mm) | | | |
|---|---|---|---|---|---|---|---|---|
| | Outer peripheral part | Thin-walled Part | Thick-walled Part | Rib | Central part | Outer peripheral part | Thin-walled part | Rib |
| Comparative example 1 | 100 | — | — | — | — | 2.5 | — | — |
| Comparative example 2 | 58 | — | 42 | — | 3.6 | 2.3 | — | — |
| Example 1 | 45 | 11 | 40 | 4 | 3.6 | 2.3 | 2.0 | 3.3 |
| Example 2 | 47 | 11 | 42 | | 3.6 | 2.3 | 2.0 | — |
| Example 3 | 45 | 11 | 40 | 4 | 3.6 | 2.3 | 2.0 | 3.1 |
| Example 4 | 45 | 11 | 40 | 4 | 3.6 | 2.3 | 2.0 | 2.9 |
| Example 5 | 45 | 11 | 40 | 4 | 3.8 | 2.2 | 2.0 | 3.3 |
| Example 6 | 45 | 11 | 40 | 4 | 3.4 | 2.4 | 2.0 | 3.3 |

As shown in FIG. 6, the simulation result was such that the initial velocity of the face member having a uniform thickness (comparative example 1) was high when the hitting point was in a range of ±12.5 mm from the center, but decreased when the hitting point exceeded ±12.5 mm from the center. Also, as shown in FIG. 7, the simulation result was such that the deflection of comparative example 1 was very large when the hitting point was in the center, but the deflection decreased significantly when the hitting point was far from the center. In contrast, as shown in FIG. 6, the initial velocity of example 1 was kept low when the hitting point was in the center, and was higher than the initial velocity of comparative example 1 at a position at which the hitting point was ±12.5 mm from the center. Also, as shown in FIG. 7, the simulation result was such that the deflection of example 1 was kept at a value approximately equal to that at the time when the hitting point was in the center even at the point at which the hitting point was ±12.5 mm from the center.

Also, the initial velocity of the face member having no thin-walled part (comparative example 2) was approximately equal to that of example 1, but was lower than that of example 1 at a hitting point ±12.5 mm from the center. Similarly, the deflection of comparative example 2 was also slightly greater than that of example 1 when the hitting point was in the range of ±12.5 mm from the center, but decreased significantly as compared with example 1 at a hitting point separated ±12.5 mm from the center. From this result, it was found that by providing the thin-walled part, the resilience property close to that at the time when a ball is hit by the sweet spot can be achieved even when a ball was hit by the thin-walled part deviating from the sweet spot.

The initial velocity of example 2 in which the rib was not provided was approximately equal to that of example 1 in which the rib was provided. Also, as in example 1 in which the rib was provided, the deflection of example 2 in which the rib was not provided was kept at almost the same value at any hitting points, and was greater than that of example 1 in which the rib was provided especially for the time of center hitting. From this result, it was found that by providing the rib, the deformation of the face part was restrained, and the resilience property at the time of off-center hitting was made more even.

Figure 8:
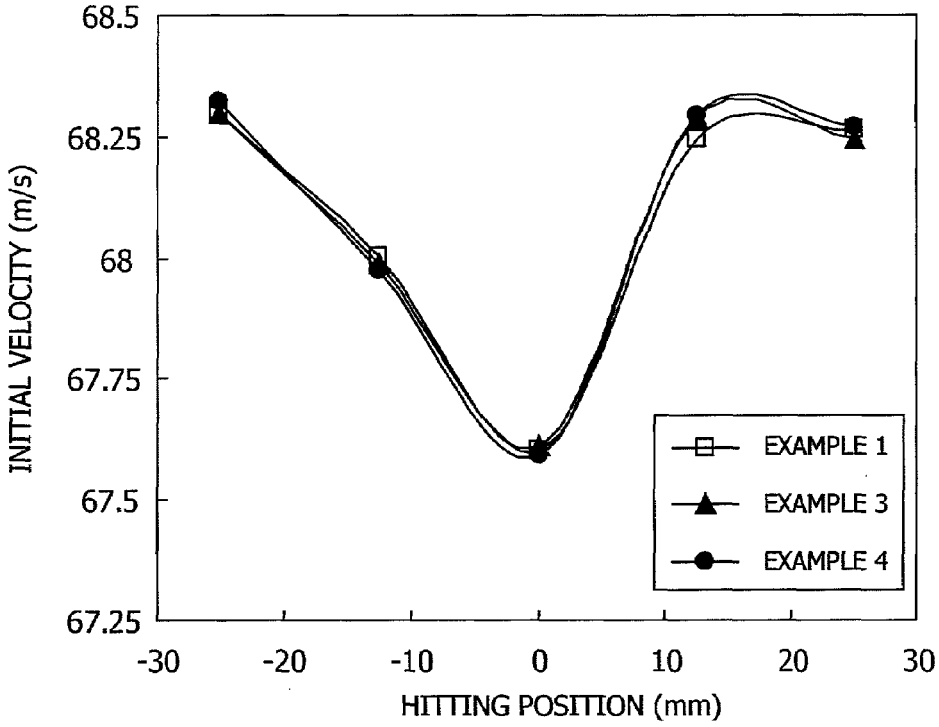
FIG. 8 is a graph showing simulation results of initial velocity of examples 3 and 4.
Figure 9:
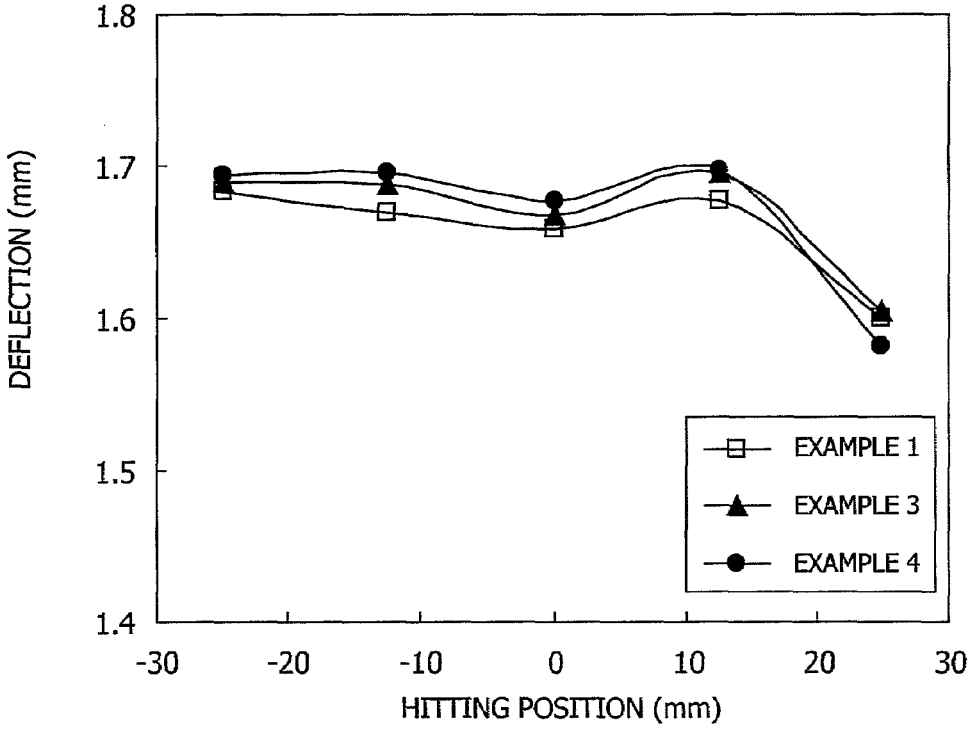
FIG. 9 is a graph showing simulation results of deflection of examples 3 and 4.

Next, the initial velocity and the deflection were simulated under the same conditions as those of example 1, except that the thickness of the outer edge of the rib was set at 3.1 mm and 2.9 mm as give in Table 1 (examples 3 and 4). These results are shown in FIGS. 8 and 9. As shown in FIG. 8, even if the thickness of the rib was small, no special change was found. As shown in FIG. 9, the deflection of example 3 in which the rib thickness was 0.2 mm thinner than that of example 1 was greater than that of example 1 as a whole, and the deflection of example 4 in which the rib thickness was 0.4 mm thinner than that of example 1 was even greater than that of example 1 as a whole. From this result, it was found that as the thickness of the outer edge of rib increases, the decrease in resilience property at the time of off-center hitting can be restrained.

Figure 10:
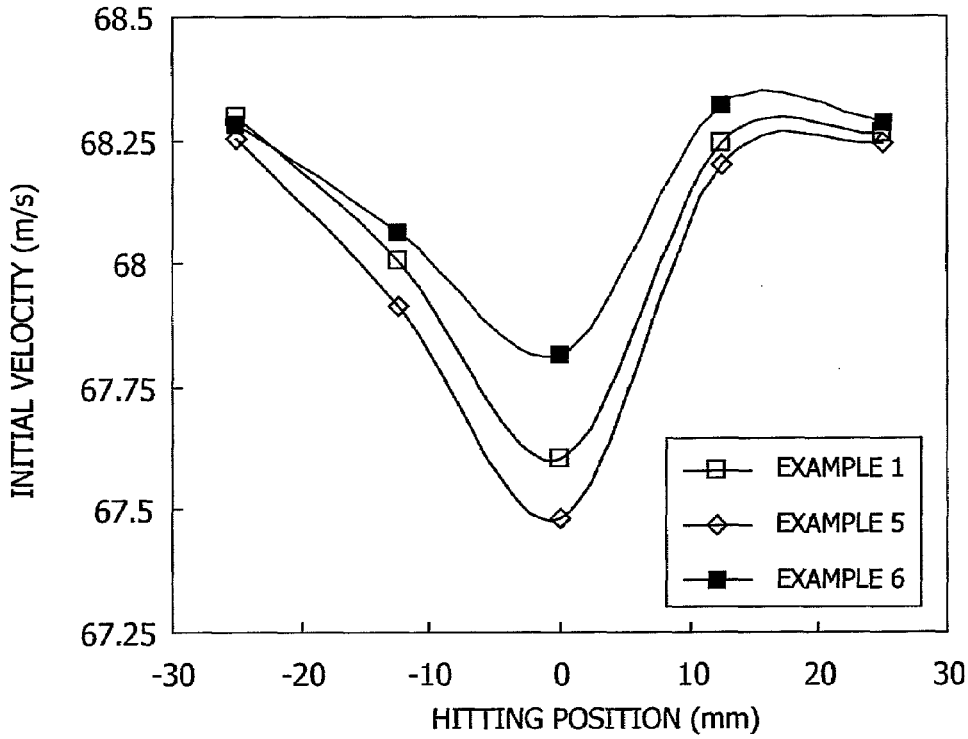
FIG. 10 is a graph showing simulation results of initial velocity of examples 5 and 6.
Figure 11:
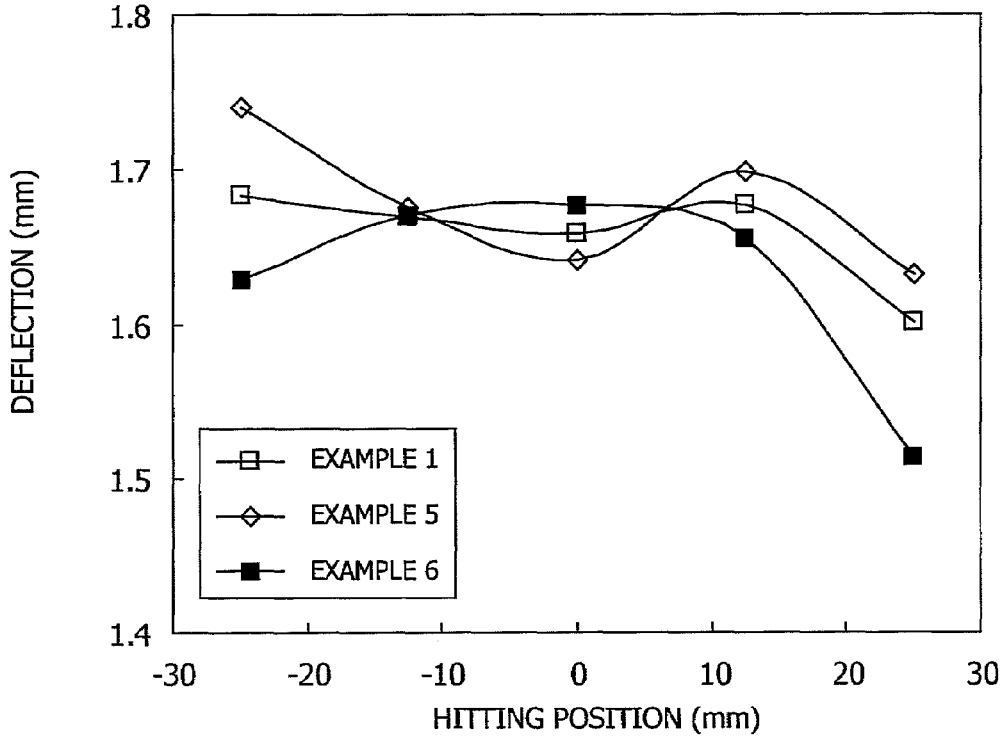
FIG. 11 is a graph showing simulation results of deflection of examples 5 and 6.

Also, a simulation was performed under the same conditions as those of example 1, except that the thickness of the central part was set at 3.8 mm, and the thickness of the outer peripheral part was set at 2.2 mm, whereby the height difference in the thick-walled part was increased from 1.3 mm to 1.6 mm, as shown in Table 1 (example 5). Also, a simulation was performed under the same conditions as those of example 1, except that the thickness of the central part was set at 3.4 mm, and the thickness of the outer peripheral part was set at 2.4 mm, whereby the height difference in the thick-walled part was conversely decreased to 1.0 mm (example 6). These results are shown in FIGS. 10 and 11. As shown in FIG. 10, the initial velocity of example 5 in which the height difference in the thick-walled part was increased was lower than that of example 6 in which the height difference in the thick-walled part was decreased, especially when the hitting point was in the center. Also, as shown in FIG. 11, the deflection of example 5 in which the height difference in the thick-walled part was increased was smaller than that of example 6 in which the height difference in the thick-walled part was decreased when the hitting point was in the center, and was greater when the hitting point was ±35 mm from the center. From this result, it was found that as the height difference in the thick-walled part increases, an effect of enhancing the resilience property at the time of off-center hitting can be achieved.

Figure 12:
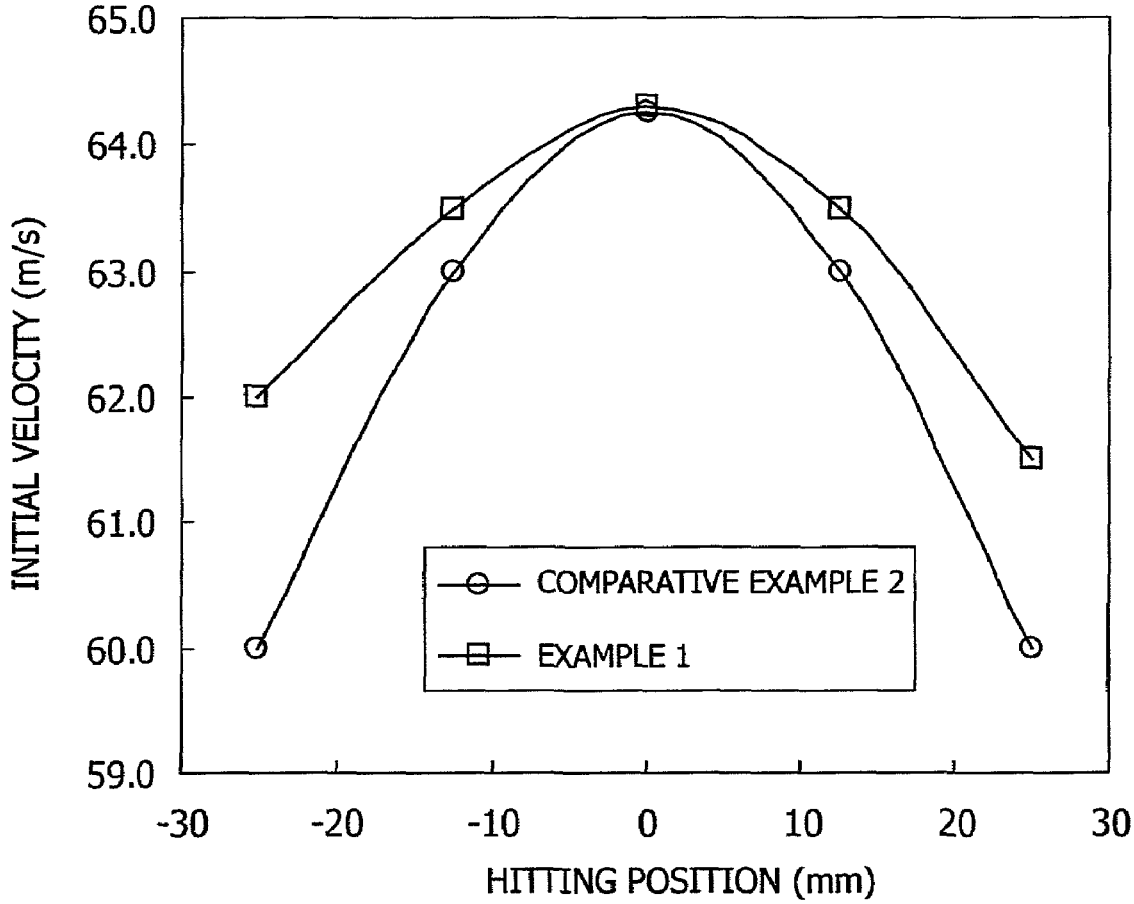
FIG. 12 is a graph showing simulation results of initial velocity of example 1 considering the conditions of a head body.

In the simulation of the above-described examples 1 to 6 and comparative examples 1 and 2, the initial velocity of a ball was calculated from the face member only, so that there was obtained the result that the initial velocity at the time when a ball was hit by a face part other than the sweet spot was higher than the initial velocity at the time when a ball was hit by the sweet spot. Therefore, the face members meeting the conditions of example 1 and comparative example 2 were combined with the head body, respectively, and the ball initial velocity was simulated under the conditions of a head volume of 452 cc and a head weight of 185 g. The results are shown in FIG. 12. As shown in FIG. 12, in both example 1 and comparative example 2, as the hitting point deviated from the sweet spot, the initial velocity of the ball was decreased. However, in example 1, the decrease in ball initial velocity at the time of off-center hitting was relaxed greatly as compared with comparative example 2.

What is claimed is:

1. A golf club head having a sole, a crown, a toe, and a heel and comprising a face part formed of a metallic material, the face part comprising: an outer peripheral portion; a thick-walled portion having a wall thickness greater than that of the outer peripheral portion, the wall thickness of the thick-walled portion being greatest in a central portion of the face part and decreasing gradually from the central portion toward the outer peripheral portion, wherein the thick-walled portion is configured as a circular or elliptical shape having depressions on two opposite sides thereof, the depressions comprising a first depression on the toe side being directed toward the central portion of the face part and a second depression on the heel side being directed toward the central portion of the face part; and at least two thin-walled portions having a wall thickness less than that of the outer peripheral portion, each of the thin-walled portions being positioned over a region surrounded by one of the two opposite sides of the circular or elliptical shape and one of the depressions, wherein the thick-walled portion is directly adjacent to the outer peripheral portion on the sole and crown sides thereof; wherein the face part further comprises a rib extending from an outer edge on the heel side and on the crown side of the face part to an outer edge on the toe side and the sole side thereof passing through the central portion of the thick-walled portion, and the rib has a wall thickness greater than that of the outer peripheral portion; and wherein a ratio of areas which the outer peripheral portion, the thin-walled portion, the thick-walled portion, and the rib occupy in the total area of the face part is 16-20:2-6:14-18:1-6.

2. The golf club head according to claim 1, wherein a ratio of areas which the outer peripheral portion, the thin-walled portion, and the thick-walled portion occupy in the total area of the face part is 8-10:1-3:7-9.

3. The golf club head according to claim 1, wherein the wall thickness of the central portion of the thick-walled portion is about 3.4 to about 4.0 mm, the wall thickness of the thin-walled portion is about 1.8 to about 2.2 mm, and the wall thickness of the outer peripheral portion is about 2.1 to about 2.5 mm.

4. The golf club head according to claim 1, wherein the wall thickness of the rib is about 2.5 to about 4.0 mm.

5. The golf club head according to claim 1, wherein a center of one or both of the depression lie along a line inclined with respect to a horizontal line extending across the face part.

6. The golf club according to claim 5, wherein an inclination angle of the line with respect to the horizontal line is selected from the range of 5 degrees to 40 degrees.

* * * * *